US008476819B2

(12) United States Patent
Guo et al.

(10) Patent No.: US 8,476,819 B2
(45) Date of Patent: Jul. 2, 2013

(54) TRIODE-STRUCTURED FIELD EMISSION DISPLAY WITH ANODE AND GATE ON THE SAME SUBSTRATE

(76) Inventors: Tailiang Guo, Fujian (CN); Yongai Zhang, Fujian (CN); Zhixian Lin, Fujian (CN); Liqin Hu, Fujian (CN); Yun Ye, Fujian (CN); Yuxiang You, Fujian (CN)

( * ) Notice: Subject to any disclaimer, the term of this patent is extended or adjusted under 35 U.S.C. 154(b) by 0 days.

(21) Appl. No.: 13/511,698

(22) PCT Filed: Aug. 12, 2011

(86) PCT No.: PCT/CN2011/078370

§ 371 (c)(1), (2), (4) Date: May 24, 2012

(87) PCT Pub. No.: WO2012/094889

PCT Pub. Date: Jul. 19, 2012

(65) Prior Publication Data

US 2013/0026906 A1 Jan. 31, 2013

(30) Foreign Application Priority Data

Jan. 10, 2011 (CN) ..... 2011 1 0003471

(51) Int. Cl.
*H01J 29/32* (2006.01)
*H01J 29/08* (2006.01)

(52) U.S. Cl.
USPC ..... 313/496; 313/309; 313/336; 313/351

(58) Field of Classification Search
None
See application file for complete search history.

(56) References Cited

U.S. PATENT DOCUMENTS

| | | | | |
|---|---|---|---|---|
| 5,556,316 | A * | 9/1996 | Taylor et al. | 445/50 |
| 6,242,865 | B1 * | 6/2001 | Zimlich | 315/169.3 |
| 2003/0038586 | A1 * | 2/2003 | Iguchi et al. | 313/495 |
| 2007/0222362 | A1 * | 9/2007 | Sawai et al. | 313/495 |
| 2010/0264805 | A1 * | 10/2010 | Fennimore et al. | 313/308 |
| 2011/0057555 | A1 * | 3/2011 | Yamamoto et al. | 313/310 |

* cited by examiner

*Primary Examiner* — Ashok Patel

(57) ABSTRACT

The present invention relates to a triode field emission display with anode and gate on the same substrate, comprising anode-gate substrate and cathode substrate, parallel and adapted in the size; a number of strip-like cathode conducting layers arranged alternating on the cathode substrate; resistor layer for current limiting and dielectric layer for cathode protection are arranged alternately on the cathode conducting layer in the longitudinal direction; the electron emission materials are arranged on the resistor layer for current limiting; wherein the strip-like anode conducting layer and strip-like gate conducting layer on the anode-gate substrate are perpendicular to the strip-like cathode conducting layer on the cathode substrate, dielectric layer for isolation is arranged between the anode-gate and the cathode substrates, one end of the dielectric layer for isolation is connected to the dielectric layer for gate protection, the other end is connected to the dielectric layer for cathode protection.

9 Claims, 6 Drawing Sheets

TRIODE-STRUCTURED FIELD EMISSION DISPLAY WITH ANODE AND GATE ON THE SAME SUBSTRATE

TECHNICAL FIELD

The present invention relates to the fabrication technique of triode FED and, more particularly, to a novel triode structured filed emission display with anode and gate on the same substrate, and cathode on another substrate.

TECHNICAL BACKGROUND OF THE INVENTION

Field emission display (FED) is a novel flat planar display technology, the FED has the advantages of the cathode ray tube (CRT), such as wide viewing angle, colorful, high response speed. Presently, in a variety of flat panel displays, only FED can reach the high image display quality as that of the traditional CRT. The FED also has the advantages of liquid crystal display (LCD), such as thin and slight, as well as small size, light weight, low energy consumption, long life, high image quality. The FED can be classified into diode, triode and multiple structures.

The diode structure FED is composed of anode and cathode, although the fabrication process of diode structure FED is simple, low cost, it has the problems of high drive voltage and very hard to control the uniformity of electron emission, and is not suitable for the fabrication of high quality FED.

The triode FED is composed of cathode, gate and anode, and can be classified into normal gate, under gate and planar gate structures. The triode FED uses gate to control the field emission of cathode, while not the high voltage as for the diode FED.

In the following, we will provide the descriptions of normal gate, under gate and planar gate structured FED with the aides of some drawings.

FIG. 1 shows the scheme of cross-section of normal gate FED, cathode conducting layer 013, dielectric layer 014 are arranged on the back glass substrate 011, gate conducting layer 015 is arranged on the dielectric layer 014, anode conducting layer 018 is arranged on the fore glass substrate 010, phosphor layer 017 is arranged on the anode conducting layer 018. The fore substrate and back substrate are face to face aligned and packaged, whose distance is maintained and fixed by the spacers 012. The normal gate FED is easy for low voltage regulation, but the fabrication is complex and high cost. Usually, the fabrication of the dielectric layer and gate is followed by that of the electronic materials, so the cathode materials subject to damage and contamination during the preparation of the dielectric layer and gate.

FIG. 2 shows the scheme of cross-section of under gate FED, gate conducting layer 023 is arranged on the back glass substrate 021, dielectric layer 24 is arranged on the gate conducting layer 023, cathode conducting layer 025 is arranged on the dielectric layer 24, and the cathode conducting layer 025 is perpendicular to the gate conducting layer 023, field emission layer 026 is arranged on the cathode conducting layer 025, anode conducting layer 028 is arranged on the fore glass substrate 020, phosphor layer 027 is arranged on the anode conducting layer 028. The gate conducting layer 023 is underneath the cathode conducting layer 025, the field emission material is fabricated after the fabrication of the gate conducting layer 023 and the dielectric layer 24. The fabrication of under gate FED is relative simple and is easier to realize. However, the electron dispersion is serious, the beam spots are large, and the cross-talk of the neighbor pixels is serious. The cross-talk of the neighbor pixels can be reduced by decreasing the distance between the anode and the cathode, but it goes against the increase of the anode voltage, and the efficiency of luminescence is low.

Both the normal gate and under gate FED have the difficulties of the fabrication of the gate and the cathode. FIG. 3 shows the scheme of cross-section of planar gate FED, gate conducting layer 033 and cathode conducting layer 034 are arranged on the back glass substrate 031, field emission layer 035 is arranged on the cathode conducting layer 034, anode conducting layer 036 is arranged on the fore glass substrate 030, and phosphor layer 037 is arranged on the anode conducting layer 036. The gate conducting layer 033 and the cathode conducting layer 034 are on the same plane and are parallel to each other, and can be fabricated at one time. The gate and cathode of the planar gate FED are parallel on the same plane, so it is needless of fabrication of dielectric layer between the gate and the cathode to avoid their short circuit, the fabrication is simple, but the dispersion of electrons is serious, and the beam spots are large, moreover, it needs to scan the high anode voltage to control image.

On the other hand, FED is a vacuum device, which needs some kind of supporting scaffold for isolation. The current technology is limited to fabricate the supporting structure alone; leading to the problems of distribution and placement of spacers.

In a word, it is necessary to develop a novel structured FED, whose fabrication processes of cathode and gate are simple, and controlled by a low voltage, the placement of spacers between the two substrates is also easy, at the same time, it can easily control the cross-talk between the two neighbor pixels caused by the electron dispersion.

SUMMARY OF THE INVENTION

The purpose of this invention is to provide a triode field emission display with anode and gate on the same substrate, by overcoming the deficiencies of the existing technology. This FED is reasonable in structure design, simple in fabrication, moreover, the electron dispersion is little, and the image display quality is good.

To achieve the above purpose, the technology options of this invention are: A triode field emission display with anode and gate on the same substrate, comprising anode-gate substrate and cathode substrate, which are parallel and adapted in the size, wherein: a number of strip-like anode conducting layer are arranged on the anode-gate substrate alternating and side by side, bus electrodes are arranged on the anode conducting layer along the longitudinal centerline, a under-gate dielectric layer is arranged on the anode-gate substrate, the under-gate dielectric layer is composed of a number of longitudinal strips alternating and a number of lateral branch strips arranged on one side or both sides of the longitudinal strips, the longitudinal strips are parallel to anode conducting layer and are arranged on the part of the anode-gate substrate that is not covered by the anode conducting layer, strip-like gate conducting layer and dielectric layer for gate protection are arranged ordinal on the longitudinal strips, the lateral branch strips cover on the anode conducting layer, phosphor layer is arranged on the part of the anode-gate substrate that is not covered by the lateral branch strips;

A number of strip-like cathode conducting layers are arranged alternating on the cathode substrate, resistor layer for current limiting and dielectric layer for cathode protection are arranged alternating on the cathode conducting layer along the longitudinal direction, electron emission materials are arranged on the resistor layer for current limiting;

The strip-like anode conducting layer and strip-like gate conducting layer on the anode-gate substrate are perpendicular to the strip-like cathode conducting layer on the cathode substrate, dielectric layer for isolation is arranged between the anode-gate substrate and the cathode substrate, one end of the dielectric layer for isolation is connected to the dielectric layer for gate protection, the other end is connected to one side of the dielectric layer for cathode protection.

The benefits of the present invention are: the cathode is fabricated on the cathode substrate, the anode and gate are fabricated on the anode-gate substrate, the cathode and the gate are fabricated on two different substrates, it is needless of consideration of the fabrication effects of gate on the cathode, therefore, this fabrication process can protect the field emission materials, increase the efficiency, uniformity and stability of the electron emission. Although the gate and the anode are fabricated on the same substrate, as the gate and the anode are parallel to each other on the same plane, it is needless of the dielectric layer for isolation, greatly reduce the difficulty of device fabrication, and the reliability of device. The cathode and the gate are not on the same substrate, which made the fabrication simpler, and reduce the difficulty of the fabrication of dielectric layer between the cathode and the gate, effectively reduce the contamination and damage of the field emission materials on the cathode conducting layer when fabricating the gate conducting layer, at the same time, it can realize low voltage controlling, and reduce the cross-talk between the neighbor pixels caused by the electron dispersion.

Figure 1:
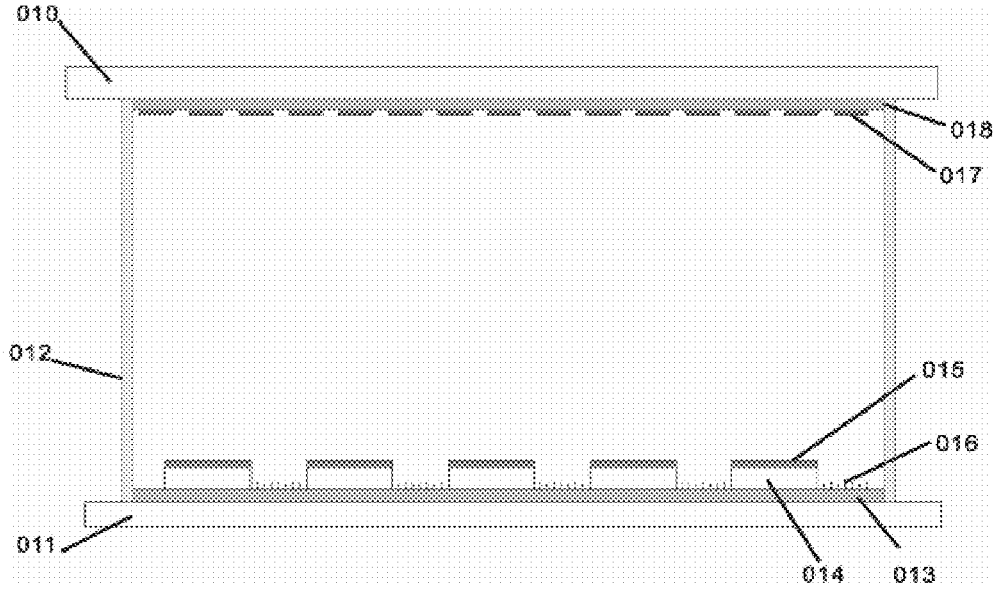
FIG. 1 shows the scheme of cross-section of the normal gate FED.
Figure 2:
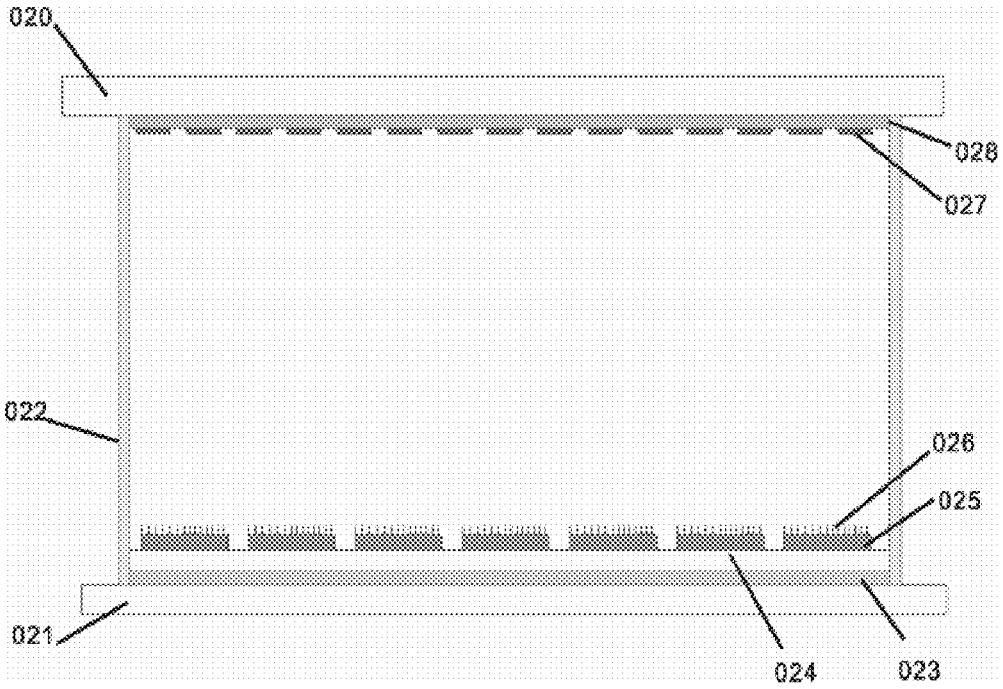
FIG. 2 shows the scheme of cross-section of the under gate FED.
Figure 3:
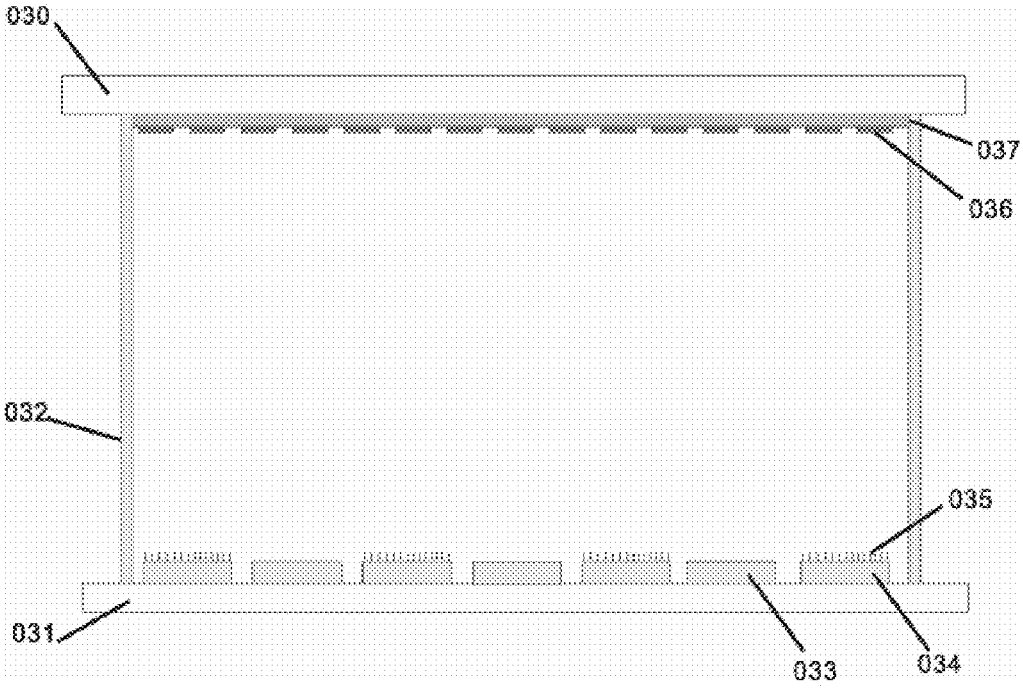
FIG. 3 shows the scheme of cross-section of the planar gate FED.

In the drawings, the main components are labeled as follows: 110—anode-gate substrate; 111—anode-gate substrate; 112—phosphor layer; 113—anode bus electrode; 120—under-gate dielectric layer; 121—gate conducting layer; 122—dielectric layer for gate protection; 130—cathode substrate; 131—cathode conducting layer; 132—resistor layer for current limiting; 133—electron emission material; 134—dielectric layer for cathode protection; 135—dielectric layer for isolation.

DETAILED DESCRIPTION OF THE INVENTION

The triode field emission display with anode and gate on the same substrate presented in the invention, comprising anode-gate substrate and cathode substrate, which are parallel and adapted in the size, wherein: a number of strip-like anode conducting layer are arranged on the anode-gate substrate alternating and side by side, bus electrodes are arranged on the anode conducting layer along the longitudinal centerline, a under-gate dielectric layer is arranged on the anode-gate substrate, the under-gate dielectric layer is composed of a number of longitudinal strips alternating and a number of lateral branch strips arranged on one side or both sides of the longitudinal strips, the longitudinal strips are parallel to anode conducting layer and are arranged on the part of the anode-gate substrate that is not covered by the anode conducting layer, strip-like gate conducting layer and dielectric layer for gate protection are arranged ordinal on the longitudinal strips, the lateral branch strips cover on the anode conducting layer, phosphor layer is arranged on the part of the anode-gate substrate that is not covered by the lateral branch strips;

A number of strip-like cathode conducting layers are arranged alternating on the cathode substrate, resistor layer for current limiting and dielectric layer for cathode protection are arranged alternating on the cathode conducting layer along the longitudinal direction, electron emission materials are arranged on the resistor layer for current limiting;

The strip-like anode conducting layer and strip-like gate conducting layer on the anode-gate substrate are perpendicular to the strip-like cathode conducting layer on the cathode substrate, dielectric layer for isolation is arranged between the anode-gate substrate and the cathode substrate, one end of the dielectric layer for isolation is connected to the dielectric layer for gate protection, the other end is connected to one side of the dielectric layer for cathode protection.

The strip-like gate conducting layer on the anode-gate substrate is aligned to the electrode emission layer and dielectric layer for isolation on the cathode substrate, the phosphor layer on the anode-gate substrate is aligned to the part of the dielectric layer for cathode protection that is not covered by the dielectric layer for isolation on the cathode substrate.

The dielectric layer for gate protection having a hole, the position of the openings is correspond to the electron emission layer, the area ratio of the hole size and the dielectric layer for gate protection is 0~100%.

The dielectric layer for gate protection is fabricated by the metal-oxide semiconductor materials.

The area of dielectric layer for cathode protection is larger than that of the dielectric layer for isolation.

The thickness of the under-gate dielectric layer is 10~1000 μm, the thickness of the dielectric layer for gate protection is 0.1~100 μm, the thickness of the dielectric layer for cathode protection is 0.1~100 μm, the thickness of the dielectric layer for isolation is 10~1000 μm, the distance between the cathode and the anode, the cathode and the gate are adjusted by controlling the thickness of the under-gate dielectric layer, the dielectric layer for gate protection, the dielectric layer for cathode protection and the dielectric layer for isolation.

The phosphor layer is also arranged on the sidewall of the under-gate dielectric layer.

The conductivity of the bus electrodes on anode layer is greater than that of anode conducting layer; the materials of the cathode conducting layer, the resistor layer for current limiting, the anode conducting layer, the bus electrode on anode can be Si, or single-layer film of Ag, Al, Cu, Fe, Ni, Au, Cr, Pt, Ti, or their multilayer film of composite or alloy film, or metal oxide of semiconductor film and slurry of Sn, Zn, In, or the metal particles of one or more metal elements of Ag, Al, Cu, Fe, Ni, Au, Cr, Pt, Ti.

The electron emitter comprise of 0-D, 1-D and 2-D micro- and nano-materials.

In the following, we provide further details of the present invention using some drawings and embodiments.

Figure 4:
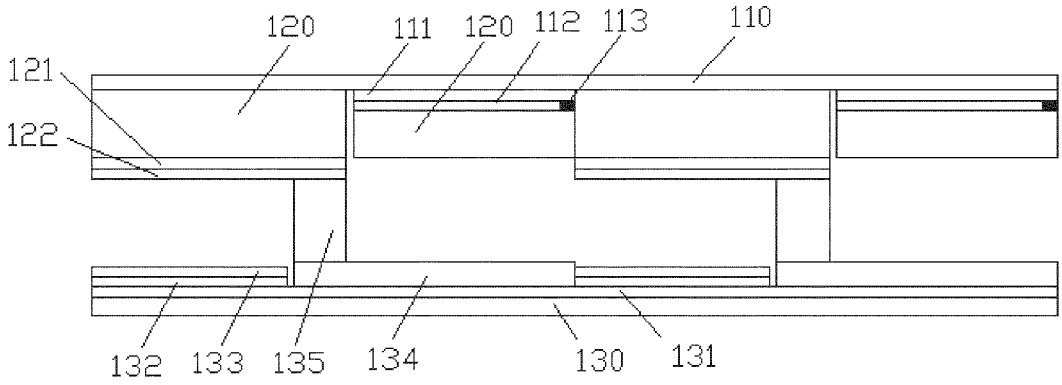
FIG. 4 shows the cutaway view of this embodiment.
Figure 5:
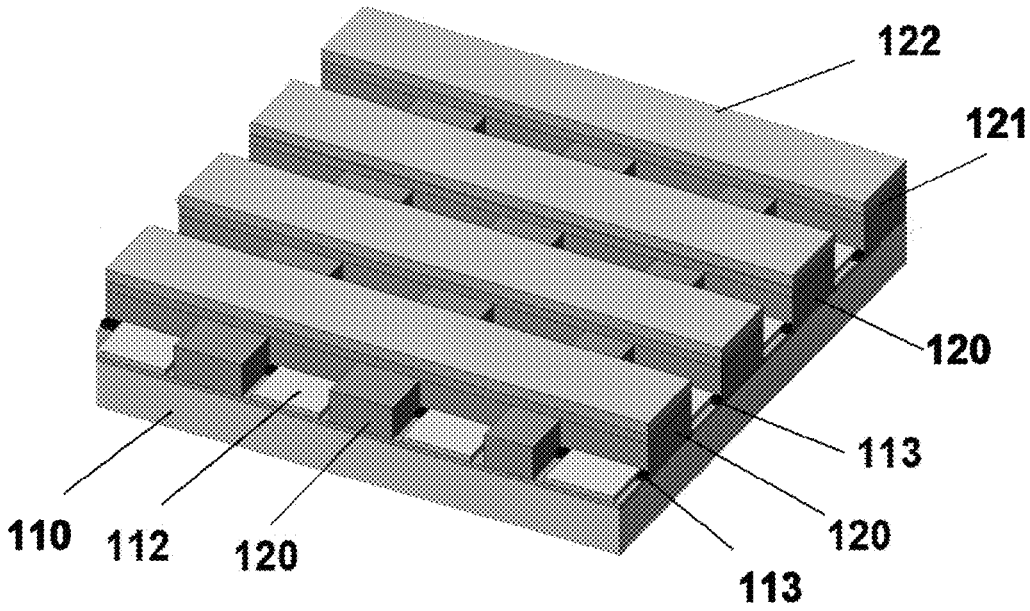
FIG. 5 shows the scheme of anode-gate substrate of this embodiment.
Figure 6:
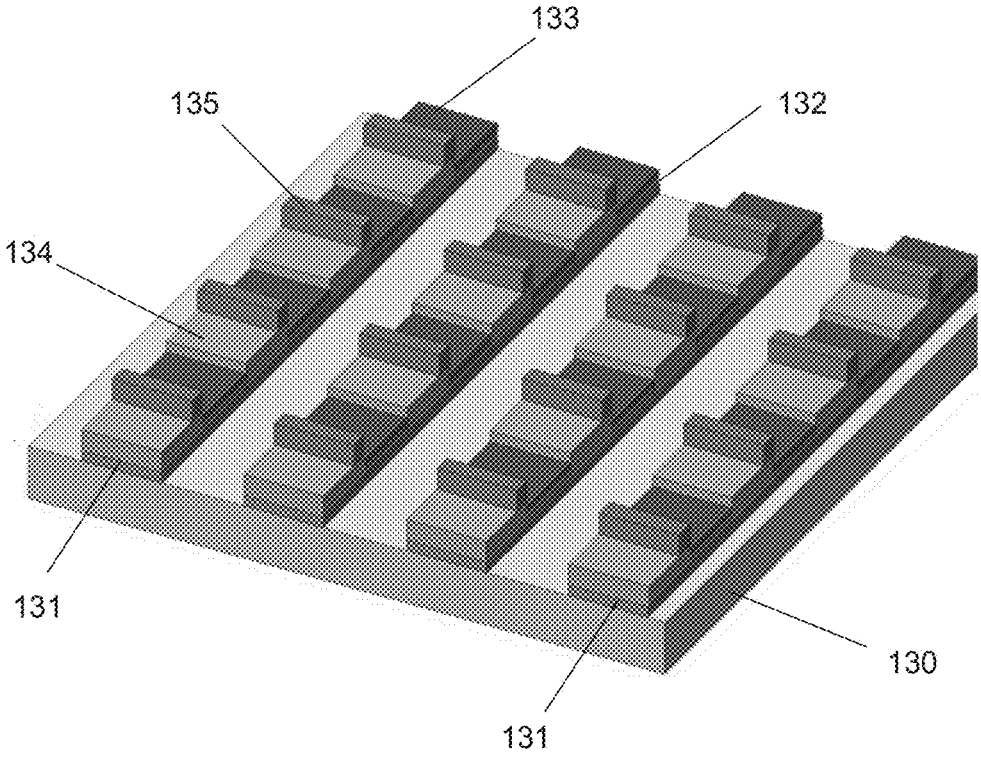
FIG. 6 shows the scheme of cathode substrate of this embodiment.

As shown in FIG. 4-6, the triode field emission display with anode and gate on the same substrate, comprising cathode substrate 130 and anode-gate substrate 110.

Strip-like cathode conducting layers 131 are arranged on the cathode substrate 130, resistor layer for current limiting 132 is arranged on some part of the cathode conducting layer 131, electron emission materials 133 are arranged on the resistor layer for current limiting 132, dielectric layer for cathode protection 134 is arranged on the part of cathode conducting layer 131 where is not covered by the resistor layer for current limiting 132, dielectric layer for isolation 135 is arranged on some part of the dielectric layer for cathode protection 134.

Strip-like and transparent anode conducting layers 111 are arranged on the anode-gate substrate 110, bus electrodes 113 are arranged on some part of the strip-like and transparent anode conducting layer 111, phosphor layer 112 is also arranged on some other part of the strip-like and transparent anode conducting layer 111, an under-gate dielectric layer 120 is arranged parallel to the transparent anode conducting layer 111 on the anode-gate substrate 110, gate conducting layer 121 is arranged on the under-gate dielectric layer 120, dielectric layer for gate protection 122 is arranged on the gate conducting layer 121.

The electron emitters 133 on the cathode substrate 130 comprise one or two kinds of 0-D, 1-D or 2-D nano-materials, whose size of low dimension is 1~100 nm and high dimension is 100 nm~20 μm. This material can be CNTs, C nano-fibre, ZnO, MgO, $SnO_2$ or other similar nano-materials. In this embodiment, preferentially, we fabricate the electron emitters 133 by transferring CNTs on the resistor layer for current limiting 132 of the cathode substrate 130 using electrophoresis deposition.

The described resistor layer for current limiting 132 comprises semiconductors and conductors, the purpose is to improve the uniformity of the emission electrons and the stability of the emission current on the cathode, which make the distribution of the field emission light spot and the emission current more uniform, and improve the uniformity of the FED luminescence.

The dielectric layer for isolation 135 is arranged on some part of the dielectric layer for cathode protection 134, whose area is little than that of the dielectric layer for cathode protection 134. The dielectric layer for isolation 135 can also be arranged on the cathode substrate 130 or on the dielectric layer for gate protection 122 of the anode-gate substrate 110.

In this invention, the fabrication processes of cathode substrate are as follows:

1. Fabrication of the cathode conducting layers 131. The starting material of the cathode substrate 130 is transparent glass, first, the strip-like cathode conducting layer 131 can be fabricated either using screen printing of conducting materials on glass substrate 130, or using photolithography if there is a layer of conducting film on the glass substrate 130. In this embodiment, preferentially, we use magnetron sputtering to deposit CrCuCr conducting film on the glass substrate 130, then fabricate the CrCuCr strips (cathode conducting layer 131) after a series of processes like exposure, development and etching.

2. Fabrication of resistor layer for current limiting 132 on the top of cathode electrodes 131. In this embodiment, first, a layer of conducting film is deposited on the surface of CrCuCr strip-like cathode 131, after exposure and etching processes, the resistor layer for current limiting 132 are formed on some part of the cathode conducting layer 131, finally, the substrate is annealed under vacuum condition or under the protection of N2 to remove the organic solvents.

3. Fabrication of dielectric layer for cathode protection 134 and dielectric layer for isolation 135 on the strip-like cathode conducting layer 131. The thickness of the dielectric layer for cathode protection 134 is (0.1~100) μm, the thickness of the dielectric layer for isolation 135 is (10~1000) μm. The dielectric layer for cathode protection 134, the dielectric layer for isolation 135 are fabricated on the part of cathode conducting layer 131 where is not covered by the resistor layer for current limiting 132 using screen printing, photolithography or coating. In this embodiment, preferentially, a layer of dielectric film is printed on the part of cathode conducting layer 131 where is not covered by the resistor layer for current limiting 132 using screen printing, after exposure and etching, the substrate is sintered under the protection of N2 to form the dielectric layer for cathode protection 134, dielectric layer for isolation 135.

4. Fabrication of electron emission layer 133 on the resistor layer for current limiting 132. This step can be achieved by transferring the field emission nano-materials on the resistor layer for current limiting 132 using electrophoresis, screen printing, spraying, and chemical vapor deposition. In this embodiment, preferentially, CNTs are deposited on the resistor layer for current limiting 1322 using electrophoresis followed by the sintering process under the protection of N2.

In this invention, the fabrication processes of anode-gate substrate 110 are as follows:

1. Fabrication of anode conducting layer 111 on substrate 110. The strip-like anode 111 is fabricated on the transparent conducting glass substrate 110 using exposure and etching. Preferentially, we screen print photoresist on the ITO substrate 110, after exposure, development and etching, we get the strip-like anode conducting layer 111.

2. Fabrication of anode bus electrodes 113 on the anode conducting layer 111. The anode bus electrodes 113 on the anode conducting layer 111 can be realized using screen printing and/or photolithography, the area of anode bus electrodes 113 is smaller than that of the anode conducting layer 111, and can be located at the center or on the both edges of the anode conducting layer 111. Preferentially, we print a layer of conducting and photo-sensitive silver slurry on the substrate with prepared anode conducting layer 111, after exposure and development, and sintered under the protection of $N_2$, we achieve the anode bus electrodes 113, whose area is about 5% of that of anode conducting layer 111.

3. Fabrication of under-gate dielectric layer 120 and gate conducting layer 121 that are parallel to the anode conducting layer 111 after the fabrication of anode conducting layer 111 and anode bus electrodes 113. The thickness of the under-gate dielectric layer 120 is 10~1000 μm. Method 1: we print a layer of photo-sensitive dielectric layer on the substrate with prepared anode conducting layer 111 and anode bus electrode 113, after exposure, development and sintering, we achieve the comb-like under-gate dielectric layer 120 that is parallel to the anode conducting layer 111, some of the anode conducting layer 111 will be covered by the under-gate dielectric layer 120, the under-gate dielectric layer 120 can also be fabricated by directly screen printing. The strip-like gate conducting layer 121 is fabricated by screen printing or exposure-development followed by sintering on the strip-like under-gate dielectric layer 120. Method 2: a layer of dielectric film that can be etched is screening printed on the substrate with prepared anode conducting layer 111 and anode bus electrode 113, after sintering under high temperature, the gate conducting layer 121 can be fabricated on the dielectric film that can be etched. The under-gate dielectric layer 120 can be achieved by etching the dielectric film that is not covered by the gate conducting layer 121. Preferentially, the gate conducting layer 121 is fabricated directly by screen printing, and covering some part of the anode conducting layer 111. Then, a layer of photo-sensitive silver slurry is screening printed on the under-gate dielectric layer 120, after photolithography and sintering, we achieve the gate conducting layer 121 that are parallel to the anode conducting layer 111.

4. Fabrication of dielectric layer for gate protection 122. The thickness of the dielectric layer for gate protection 122 is 0.1~100 μm, and can be achieved by screen printing or exposure-development-etching or spraying, followed by sintering under the protection of N2. Preferentially, the dielectric layer for gate protection 122 is screening printed directly on the gate conducting layer 121 using screen printing.

5. Fabrication of phosphor layer 112 on the anode conducting layer 111 where is not covered by the under-gate dielectric layer 120 using screen printing or spraying. The phosphor layer 112 can be located on the anode conducting layer 111 where is not covered by the under-gate dielectric layer 120 or at the side wall of the under-gate dielectric layer 120. Preferentially, the phosphor layer 112 is deposited both on the anode conducting layer 111 where is not covered by the under-gate dielectric layer 120 or at the side wall of the under-gate dielectric layer 120 using screen printing.

For the triode field emission display with anode and gate on the same substrate presented in the embodiment, a high voltage is applied on the anode, the electron emission layer emit electrons under the electric field of gate. Some of the electrons absorb by the gate, some other electrons bombard the phosphors layer on the anode under the electric field of anode, which will cause luminescence, leading to the field emission display. The triode field emission display with anode and gate on the same substrate will regulate the field emission of the emission layer by controlling the gate voltage, the anode collects the electrons which will bombard the R, G, B three-color phosphors, leading to the luminescence and display of image.

Although the present invention has been described with respect to the foregoing preferred embodiments, it should be understood that various other changes, omissions and deviations in the form and detail thereof may be made without departing from the scope of this invention.

What is claimed is:

1. A triode-structured field emission display with anode and gate on the same substrate, comprising:

anode-gate substrate and cathode substrate parallel to each other and adapted in the size, strip-like anode conducting layers arranged on the anode-gate substrate alternating and side by side, bus electrodes arranged on the anode conducting layers along the longitudinal centerline, under-gate dielectric layers arranged on the anode-gate substrate, wherein the under-gate dielectric layers further comprising longitudinal strips alternating and lateral branch strips arranged on one side or both sides of the longitudinal strips, wherein the longitudinal strips are parallel to strip like anode conducting layers and are arranged on the part of the anode-gate substrate that is not covered by the anode conducting layers, strip-like gate conducting layer, dielectric layers for gate protection, wherein the strip-like gate conducting layers and dielectric layers for gate protection are arranged ordinal on the longitudinal strips, and wherein the lateral branch strips cover on the anode conducting layers, phosphor layers arranged on the part of the anode-gate substrate that is not covered by the lateral branch strips;

strip-like cathode conducting layers arranged alternating on the cathode substrate, wherein the strip-like anode conducting layers and strip-like gate conducting layers on the anode-gate substrate are perpendicular to the strip-like cathode conducting layer on the cathode substrate, resistor layers for current limiting, dielectric layers for cathode protection, wherein the resistor layers and dielectric layers for cathode protection are arranged alternating on the cathode conducting layers along the longitudinal direction, electron emission materials arranged on the resistor layers for current limiting;

dielectric layers for isolation arranged between the anode-gate substrate and the cathode substrate, wherein one end of the dielectric layers for isolation is connected to the dielectric layers for gate protection, and the other end of the dielectric layers for isolation is connected to the dielectric layers for cathode protection.

2. A triode-structured field emission display with anode and gate on the same substrate according to claim 1, wherein the strip-like gate conducting layer on the anode-gate substrate is aligned to the electrode emission layer and dielectric layer for isolation on the cathode substrate, the phosphor layer on the anode-gate substrate is aligned to the part of the dielectric layer for cathode protection that is not covered by the dielectric layer for isolation on the cathode substrate.

3. A triode-structured field emission display with anode and gate on the same substrate according to claim 1, wherein the dielectric layer for gate protection having a hole, the position of the openings is correspond to the electron emission layer, the area ratio of the hole size and the dielectric layer for gate protection is 0~100%.

4. A triode-structured field emission display with anode and gate on the same substrate according to claim 1, wherein the dielectric layer for gate protection is fabricated by the metal-oxide semiconductor materials.

5. A triode-structured field emission display with anode and gate on the same substrate according to claim 1, wherein the area of dielectric layer for cathode protection is larger than that of the dielectric layer for isolation.

6. A triode-structured field emission display with anode and gate on the same substrate according to claim 1, wherein the thickness of the under-gate dielectric layer is 10~1000 μm, the thickness of the dielectric layer for gate protection is 0.1~100 μm, the thickness of the dielectric layer for cathode protection is 0.1~100 μm, the thickness of the dielectric layer for isolation is 10~1000 μm, the distance between the cathode and the anode, the cathode and the gate are adjusted by controlling the thickness of the under-gate dielectric layer, the dielectric layer for gate protection, the dielectric layer for cathode protection and the dielectric layer for isolation.

7. A triode-structured field emission display with anode and gate on the same substrate according to claim 1, wherein the phosphor layer is also arranged on the sidewall of the under-gate dielectric layer.

8. A triode-structured field emission display with anode and gate on the same substrate according to claim 1, wherein the conductivity of the bus electrodes on anode layer is greater than that of anode conducting layer; the materials of the cathode conducting layer, the resistor layer for current limiting, the anode conducting layer, the bus electrode on anode can be Si, or single-layer film of Ag, Al, Cu, Fe, Ni, Au, Cr, Pt, Ti, or their multilayer film of composite or alloy film, or metal oxide of semiconductor film and slurry of Sn, Zn, In, or the metal particles of one or more metal elements of Ag, Al, Cu, Fe, Ni, Au, Cr, Pt, Ti.

9. A triode-structured field emission display with anode and gate on the same substrate according to claim 1, wherein the electron emitter comprising 0-D, 1-D and 2-D micro- and nano-materials.

* * * * *